United States Patent [19]

Kammerer

[11] Patent Number: 4,545,566

[45] Date of Patent: Oct. 8, 1985

[54] METAL SEALS FOR DAMPER BLADES

[75] Inventor: Fred R. Kammerer, Mt. Vernon, N.Y.

[73] Assignee: Accurate Metal Weather Strip Company, Mt. Vernon, N.Y.

[21] Appl. No.: 590,527

[22] Filed: Mar. 16, 1984

[51] Int. Cl.[4] ..... F24F 13/08

[52] U.S. Cl. ..... 251/357; 137/601; 98/110; 98/121.2

[58] Field of Search ..... 251/357; 98/110, 121 A; 137/601

[56] References Cited

U.S. PATENT DOCUMENTS

| | | | |
|---|---|---|---|
| 3,530,783 | 9/1970 | Alamprese | 98/110 |
| 3,631,790 | 1/1972 | Olsen et al. | 98/110 |
| 3,698,429 | 10/1972 | Lowe et al. | 98/110 |
| 4,199,898 | 4/1980 | Connor | 98/121 A |
| 4,325,411 | 4/1982 | Squirrell | 137/601 |

*Primary Examiner*—A. Michael Chambers

*Attorney, Agent, or Firm*—Dressler, Goldsmith, Shore, Sutker & Milnamow, Ltd.

[57] ABSTRACT

There is disclosed metal seals for damper blades, preferably made of sheet metal, as well as the combination of the blade with the metal seal. The damper blade is pivotably mountable and has longitudinally extending edges which are formed to define a groove spaced from and close to the longitudinal edge of the blade and parallel thereto. The metal seal is constituted by a rolled strip of metal formed to include a pair of opposite sides and a bottom defining a U-shaped portion, a hook portion extends inwardly from the free end of one of said sides toward the bottom of the U, and a sealing flap is reversely bent to extend away from the end of the other of said sides. In use, the U-portion of the seal is forced onto the grooved edge until the free end of the hook portion snaps and locks into the groove.

6 Claims, 5 Drawing Figures

Fig. 1
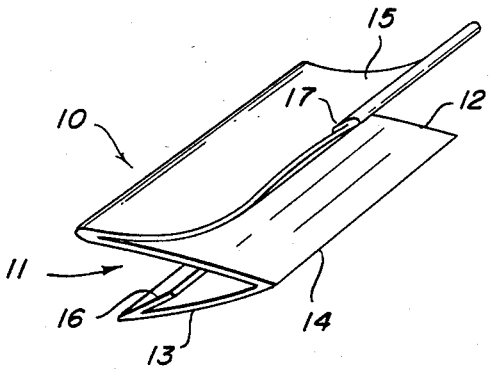
Fig. 2
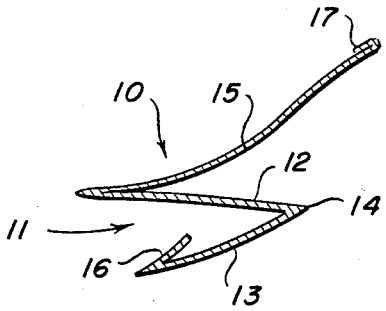
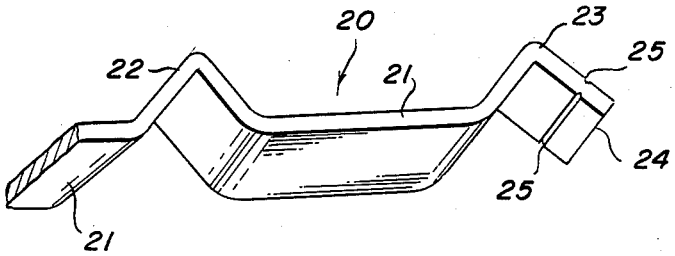
Fig. 3
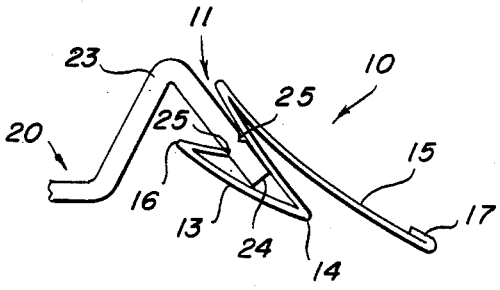
Fig. 4
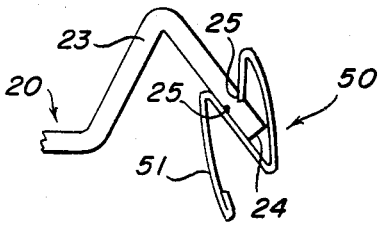
Fig. 5

METAL SEALS FOR DAMPER BLADES

DESCRIPTION

1. Technical Field

This invention relates to sealing the edges of damper blades using metal seals instead of plastic seals which are not effective when elevated temperatures are encountered.

2. Background Art

Heating and ventilating systems commonly employ ducts to guide the treated air to the various portions of a building, and dampers are positioned in these ducts to regulate the flow of air. In certain situations it is desired that the blades of a damper be pivoted into a closed position so that air and smoke cannot pass through the duct. Since the damper blades frequently leak in the closed position, which interferes with the desired blockage of air movement, elongated seals are fitted onto the longitudinal edges of the pivotable damper blades to more perfectly close the damper when the blades are in their closed position. Plastic seals are quite effective for this purpose and are in common use.

Unfortunately, these plastic seals cannot withstand the elevated temperatures which may be encountered when there is a fire in the building, and they melt or degrade. This permits smoke-filled air to move through the ducts, presenting an obvious hazard. It is frequently desired to have the dampers close when a fire takes place to prevent the undesired flow of smoke-filled air, so damage to the seals when excessive heat is encountered interferes with the sealing function when it is important that this function not be sacrificed. Some plastics, like polyvinyl chloride which is frequently used, release noxious fumes, and this may add to the hazard. The commonly used polyvinyl chloride can withstand temperatures up to about 165° C., but it can be chlorinated to withstand higher temperatures up to about 225° C. Nonetheless, a fire in the building may induce failure and the release of noxious fumes. Also, in very cold weather, these plastics become brittle and may snap and fall off.

To avoid these difficulties, efforts have been made to use metal seals, and particularly seals made of stainless steel, but these efforts have not been entirely successful. One can rivet, bolt or weld the metal seal to the edges of the damper blades, but this is expensive, and the seals can warp as a result of the securement and may end up imperfectly positioned on the blades. Also, these forms of securement prevent subsequent removal of the seals and their replacement as required. Pressure-sensitive adhesives have also been used, but these are not durable. It has not been possible to provide a metal seal which can be reliably positioned on the blade edges by simply fitting the blade edge into an opening in the seal, as can be done with plastic seals having soft internal teeth which resiliently grip the surfaces of the blade. This is because the metal seal, when simply fitted onto the edge of a metal blade, tends to work loose as the blades are moved in use. A loose fitting or dislodged seal can cause all sorts of problems in an operating damper, so the possibility of this taking place is unacceptable.

Many efforts have been made to provide dampers with pivotally mounted blades which seal properly in the closed position, which are easy to assemble and reliable in use, and which resist high temperature. However, this industrial problem has not been resolved.

DISCLOSURE OF INVENTION

In accordance with this invention, I provide a metal seal, preferably made of thin tempered metal such as stainless steel, constituted by a rolled strip of metal which is formed to include a pair of opposite sides and a bottom defining a U-shaped portion. A hook portion extends inwardly from the free end of one of said sides toward the bottom of the U, and a sealing flap is reversely bent to extend away from the end of the other of these sides. This metal seal is used in combination with a pivotably mountable damper blade which is formed with a groove spaced from and close to the longitudinal edge of the blade and parallel thereto. The U-portion of the seal is fitted onto the grooved edge until the free end of the hook snaps and locks into the groove. This precisely positions the metal seal on the damper blade, and it does so quickly and easily in a manner which prevents the seal from working loose from the edge of the blade. Particularly where the blade and the seal are both made of heat-resistant metal, the elevated temperatures which previously damaged plastic seals do not damage dampers constructed with the blade-seal combinations of this invention.

The blades are normally formed to include a central longitudinally extending bent portion which receives pivots to enable the blades to be opened and closed, and outer longitudinally extending bent portions which interfit when the blades are closed. The outer longitudinal edges of the blades are fitted with seals, and these can be attached so that the sealing flap extends from either the outer or inner surfaces of the blades, depending on whether a seal is to be had with the frame of the damper or with another blade. Two types of seals are in use, and these are formed with sealing flaps of different length, as will be illustrated hereinafter.

The invention will be more fully understood from the accompanying drawings in which:

FIG. 1 is a perspective view of a metal seal constructed in accordance with the invention;

FIG. 2 is a cross-section taken through the metal seal of FIG. 1;

FIG. 3 is a perspective view of a damper blade constructed in accordance with this invention;

FIG. 4 is a side elevation showing the metal seal in position on the blade; and FIG. 5 is a side elevation, similar to FIG. 4, but showing an alternate form of seal.

Referring more particularly to FIGS. 1 and 2, it will be seen that the metal seal 10 of this invention, which is roll formed out of thin gauge metal, preferably tempered metal, such as stainless steel having a spring steel character, is formed with a U-shaped portion 11 having side portions 12 and 13, and a bottom 14. The shape of the bottom 14 is little consequence, and in this instance it is sharp to provide an appearance which is more of V-shape than U-shape, but both are embraced herein as being of U-shape. The side 12 carries a flexible sealing flap 15 at its outer end. The other side 13 has a free end which terminates in a hook portion 16 which extends away from the side 13 back toward the bottom of the U. The sealing flap is reversely bent away from side 12 and generally parallels the side 13. The sealing flap 15 terminates in a rolled hem 17 to remove the sharp edge of the metal. If the hem 17 is not rolled down firmly, it can be called a lip, and it is still useful herein.

A portion of a typical damper blade 20 is shown in FIG. 3 where it will be seen that it comprises a sheet metal body 21 which is bent to provide a central bend 22 which adapts the blade for pivotal mounting, and oppositely facing marginal bent portions 23 at each side margin, only one of which is shown. This blade 20 will vary in size and length, depending upon the size damper in which it is to be installed. Installation is conventional, and no different in this invention than in the prior art.

The bent portion 23 terminates in a free edge 24 which is roll formed to provide grooves 25 on opposite sides of the free edge and spaced from the edge a short distance to receive the hook portion of the seal. The grooves parallel the edge 24. Two grooves are formed, and either of these grooves are used in actual practice.

The mounting of the seal 10 in the free edge 24 is shown in FIG. 4 where it will be seen that seal 10 is mounted by forcing the U-portion of the seal onto the free edge 24 until hook 16 snaps into the groove 25. The engagement is a strong one which is difficult to separate, and hence one can be confident that the seal will not work loose as the blade is pivoted back and forth within the damper, or loosen when air is passed through the duct with the blades in an open position.

In FIG. 4, it will be seen that the hook portion 16 enters the groove 25 on the interior of bent portion 23. One can also mount the seal on the blade edge with its hook locking into the groove on the exterior of bent portion 23, and this is shown in FIG. 5. Here, an alternative seal is used in which the sealing flap is shorter than in FIG. 4 so that the seal-blade combination shown in FIG. 5 is better adapted to seal the bent portions on adjacent blades when the blades are in their closed postion.

As can be seen in FIG. 5, the seal 50 has a shortened sealing flap 51, and its hook portion 52 snaps into and locks in the groove 25 on the exterior of bent portion 23.

While the specific construction of the damper is not of primary concern herein, these are normally multi-blade dampers in which the blades are pivotally mounted in spaced parallel relation to seal against one another when the blades are pivoted into the closed position. When the blades are in an open position, whether fully or partially open, the seals extend out into the open duct.

It is desired to point out that, in comparison with metal seals which have no hook portion, as provided herein, the hook portions of this invention provide better securement to a metal blade even when there is no groove therein, but the presence of the groove greatly enhances the desired permanent securement.

Also, the blades used herein are preferably metal, but the seals of this invention can also be used on fiberglass and similar blades, especially when these are grooved in the manner taught herein.

It is also stressed that the FIG. 4 construction in which the seal is mounted so that the flap extends from the exterior of the bent portion of the blade with the sealing flap being of such length that it extends beyond the edge of the blade provides the capacity to seal directly with the frame of the damper. When this is attempted with plastic seals, it is not effective because the air pressure flexes the plastic sealing flaps, and passes through the damper despite the presence of the seals. When the seals are made of metal, they are much stronger than when made of plastic, so the extended sealing flap and the seal positioning shown in FIG. 4, can be used.

What is claimed is:

1. A metal seal constituted by a rolled strip of metal formed to include a pair of opposite sides and a bottom defining a U-shaped portion, a hook portion extending inwardly from the free end of one of said sides toward the bottom of the U, and a sealing flap reversely bent to extend away from the end of the other of said sides.

2. A metal seal as recited in claim 1 in which the outer edge of said flap is formed with a lip or hem.

3. A metal seal as recited in claim 2 in which said strip of metal is of tempered metal.

4. A metal seal as recited in claim 3 in which said tempered metal is stainless steel.

5. A combination of a metal damper blade with a metal seal, said damper blade being pivotably mountable and having longitudinally extending edges which are formed to define a groove positioned close to at least one of the longitudinal edges of the blade and parallel thereto, and a metal seal constituted by a rolled strip of tempered metal formed to include a pair of opposite sides and a bottom defining a U-shaped portion, a hook portion extending inwardly from the free end of one of said sides toward the bottom of the U, and a sealing flap reversely bent to extend away from the end of the other of said sides, the U-portion of said seal being forced onto the grooved edge of said blade until the free end of said hook portion snaps and locks into said groove.

6. A combination as recited in claim 5 in which said blade is formed with a bent portion adjacent its longitudinal edges, and the hook portion of the seal on one of said edges is positioned in a groove which is on the exterior of said bent portion, with said sealing flap extending out beyond the longitudinal edge of said blade.

* * * * *